US008942607B2

(12) United States Patent
Honda et al.

(10) Patent No.: US 8,942,607 B2
(45) Date of Patent: Jan. 27, 2015

(54) GUIDE DEVICE WITH MECHANISM CAPABLE OF MINIMIZING DAMAGE TO TONER IMAGE BY WATER DROPLET AND IMAGE FORMING APPARATUS INCORPORATING SAME

(75) Inventors: Haruyuki Honda, Osaka (JP); Toshikane Nishii, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 13/484,825

(22) Filed: May 31, 2012

(65) Prior Publication Data

US 2013/0004221 A1 Jan. 3, 2013

(30) Foreign Application Priority Data

Jun. 28, 2011 (JP) ..... 2011-143294

(51) Int. Cl.
*G03G 15/20* (2006.01)
*B65H 29/52* (2006.01)
*G03G 15/00* (2006.01)

(52) U.S. Cl.
CPC ..... *G03G 15/6558* (2013.01); *G03G 15/6502* (2013.01)
USPC ..... 399/320

(58) Field of Classification Search
CPC ..... G03G 15/00; G03G 15/20; B56H 29/52
USPC ..... 399/122, 320
See application file for complete search history.

(56) References Cited

U.S. PATENT DOCUMENTS

| | | | |
|---|---|---|---|
| 7,677,555 | B2 | 3/2010 | Tanaka et al. |
| 7,878,725 | B2 | 2/2011 | Ohkubo et al. |
| 7,900,917 | B2 | 3/2011 | Fujiwara et al. |
| 7,992,860 | B2 | 8/2011 | Kimura et al. |
| 8,087,666 | B2 | 1/2012 | Honda et al. |

(Continued)

FOREIGN PATENT DOCUMENTS

| | | | | |
|---|---|---|---|---|
| JP | 01004766 A | * | 1/1989 | ..... G03G 15/00 |
| JP | 9-297491 | | 11/1997 | |

(Continued)

OTHER PUBLICATIONS

U.S. Appl. No. 13/313,786, filed Dec. 7, 2011, Unknown.

*Primary Examiner* — Nguyen Ha
(74) *Attorney, Agent, or Firm* — Oblon, Spivak, McClelland, Maier & Neustadt, L.L.P.

(57) ABSTRACT

A guide device for guiding a recording medium discharged from a fixing device includes a first conveyance wall plate and at least one rib assembly mounted on the first conveyance wall plate. The at least one rib assembly includes a plurality of primary ribs contacting the first conveyance wall plate, each having a first thickness in a recording medium conveyance direction; and a plurality of secondary ribs mounted on selected ones of the plurality of primary ribs. Each secondary rib includes a bottom contacting the primary rib and having a second thickness in the recording medium conveyance direction that is smaller than the first thickness of the primary rib; and a top contacting the recording medium and having a third thickness in the recording medium conveyance direction that is smaller than the second thickness of the bottom of the secondary rib.

15 Claims, 5 Drawing Sheets

(56) References Cited

U.S. PATENT DOCUMENTS

| | | | | |
|---|---|---|---|---|
| 8,090,303 | B2 | 1/2012 | Hayashi et al. | |
| 2002/0071699 | A1 * | 6/2002 | Baughman et al. | 399/323 |
| 2009/0110454 | A1 * | 4/2009 | Satomi | 399/341 |
| 2009/0121418 | A1 | 5/2009 | Tanaka et al. | |
| 2009/0190949 | A1 | 7/2009 | Hamahashi et al. | |
| 2009/0190974 | A1 * | 7/2009 | Sakai | 399/323 |
| 2009/0302521 | A1 | 12/2009 | Kondo et al. | |
| 2010/0192710 | A9 | 8/2010 | Hanashima et al. | |
| 2010/0314827 | A1 | 12/2010 | Nishii et al. | |
| 2011/0058829 | A1 | 3/2011 | Kondo et al. | |
| 2011/0058873 | A1 | 3/2011 | Honda et al. | |
| 2011/0115154 | A1 | 5/2011 | Fujiwara et al. | |

FOREIGN PATENT DOCUMENTS

| | | | | | |
|---|---|---|---|---|---|
| JP | 2001-39599 | | | 2/2001 | |
| JP | 2001-142331 | | | 5/2001 | |
| JP | 2001322735 | A | * | 11/2001 | B65H 5/38 |
| JP | 2007033914 | A | * | 2/2007 | G03G 15/20 |
| JP | 2007240966 | A | * | 9/2007 | G03G 15/00 |
| JP | 2008089696 | A | * | 4/2008 | |
| JP | 2008116753 | A | * | 5/2008 | G03G 15/20 |
| JP | 2008185646 | A | * | 8/2008 | G03G 15/20 |
| JP | 2009096605 | A | * | 5/2009 | G03G 15/00 |
| JP | 2010-210911 | | | 9/2010 | |
| JP | 2010-282057 | | | 12/2010 | |
| JP | 2010282057 | A | * | 12/2010 | G03G 15/20 |

* cited by examiner

GUIDE DEVICE WITH MECHANISM CAPABLE OF MINIMIZING DAMAGE TO TONER IMAGE BY WATER DROPLET AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-143294, filed on Jun. 28, 2011, in the Japanese Patent Office, the entire disclosure of which is hereby incorporated by reference herein.

BACKGROUND OF THE INVENTION

1. Field of the Invention

Exemplary aspects of the present invention relate to a guide device and an image forming apparatus, and more particularly, to a guide device for guiding a recording medium bearing a toner image and an image forming apparatus incorporating the guide device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIG. 1 illustrates a fixing device 20R installed in such image forming apparatuses, which includes a fixing roller 21R and an opposed pressing roller 22R that apply heat and pressure to a recording medium P bearing a toner image T. For example, the pressing roller 22R is pressed against the fixing roller 21R heated by a heater 32R disposed inside the fixing roller 21R to form a fixing nip NP therebetween through which the recording medium P bearing the toner image T is conveyed. As the fixing roller 21R and the pressing roller 22R rotate and convey the recording medium P through the fixing nip NP, the fixing roller 21R and the pressing roller 22R apply heat and pressure to the recording medium P, melting and fixing the toner image T on the recording medium P.

Thereafter, the recording medium P bearing the toner image T is discharged from the fixing device 20R while guided by a fixing exit guide 26R and a pressing exit guide 25R and conveyed through a guide device 40R incorporating a first conveyance path 1R created by a first conveyance wall plate 27R, a second conveyance wall plate 28R, and a third conveyance wall plate 29R in a recording medium conveyance direction D1 toward an output roller pair 17R. If a user selects single-sided printing, the recording medium P is discharged onto an output tray by the output roller pair 17R. Alternatively, if the user selects double-sided printing, immediately after the trailing edge of the recording medium P passes through a bifurcation 24, the trailing edge of the recording medium P springs toward a second conveyance path 2R by its rigidity. Before the tailing edge of the recording medium P reaches the output roller pair 17R, the output roller pair 17R reverses its direction of rotation, feeding the recording medium P toward the second conveyance path 2R. Thus, the recording medium P is conveyed through the second conveyance path 2R in a recording medium conveyance direction D2 while guided by duplex guide plates 30R and 34R constituting the second conveyance path 2R. Then, the recording medium P reenters the fixing device 20R where another toner image T is fixed on the back side of the recording medium P.

On the other hand, the image forming apparatus is requested to shorten a first print time from the time when the user enters a command to start a print job until the first recording medium P bearing the toner image T is discharged onto the output tray. To address such request, after the image forming apparatus is powered on or switched from a sleep mode to a print mode, the fixing roller 21R is configured to be heated to a predetermined fixing temperature in a shortened time. However, even when the fixing roller 21R is heated to the predetermined fixing temperature, the peripheral components of the fixing roller 21R, such as the first conveyance wall plate 27R and the duplex guide plates 30R and 34R, may be heated insufficiently. Accordingly, when an atmosphere heated by the fixing roller 21R moves to these cooler components, water droplets 31 may adhere thereto. If the water droplets 31 are transferred onto the recording medium P conveyed over the components adhered with the water droplets 31, they may damage the toner image T on the recording medium P.

To address this problem, several solutions are proposed to prevent transfer of the water droplets 31 to the recording medium P. For example, a guide plate mounting a plurality of convex ribs may be disposed downstream from the fixing roller 21R in the recording medium conveyance direction D1 so that the steps of each convex rib receive water droplets 31, thus minimizing an amount of water droplets 31 adhered to the top of the convex rib and therefore reducing the water droplets 31 that may be transferred onto the recording medium P. However, since it is difficult to suppress the height of the convex rib to ensure adequate strength, an insufficient interval may be provided between the water droplets 31 accumulated on the steps of the convex rib and the recording medium P passing over the convex rib, allowing the water droplets 31 to be transferred onto the recording medium P.

Alternatively, a guide plate mounting a plurality of wavy ribs may be disposed downstream from the fixing roller 21R in the recording medium conveyance direction D1 so that the wavy ribs minimize the contact area where they contact the recording medium P, thus reducing water droplets 31 adhering to the recording medium P. However, the recording medium P may get snagged on the wavy ribs and jammed.

Yet alternatively, the first conveyance wall plate 27R and the duplex guide plates 30R and 34R may be made of a thermal conductive material having a reduced heat capacity that facilitates heating of these plates and drying of water droplets 31 adhered thereto. However, such thermal conductive material may increase manufacturing costs.

SUMMARY OF THE INVENTION

This specification describes below an improved guide device. In one exemplary embodiment of the present invention, the guide device is disposed downstream from a fixing device that fixes a toner image on a recording medium in a recording medium conveyance direction and guides the recording medium discharged from the fixing device. The guide device includes a first conveyance wall plate and at least one rib assembly mounted on the first conveyance wall plate. The at least one rib assembly includes a plurality of primary ribs contacting the first conveyance wall plate, each having a first thickness in the recording medium conveyance direction; and a plurality of secondary ribs mounted on selected ones of the plurality of primary ribs. Each secondary rib includes a bottom contacting the primary rib and having a second thickness in the recording medium conveyance direction that is smaller than the first thickness of the primary rib; and a top contacting the recording medium and having a third thickness in the recording medium conveyance direction that is smaller than the second thickness of the bottom of the secondary rib.

This specification further describes an improved image forming apparatus. In one exemplary embodiment of the present invention, the image forming apparatus includes the guide device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
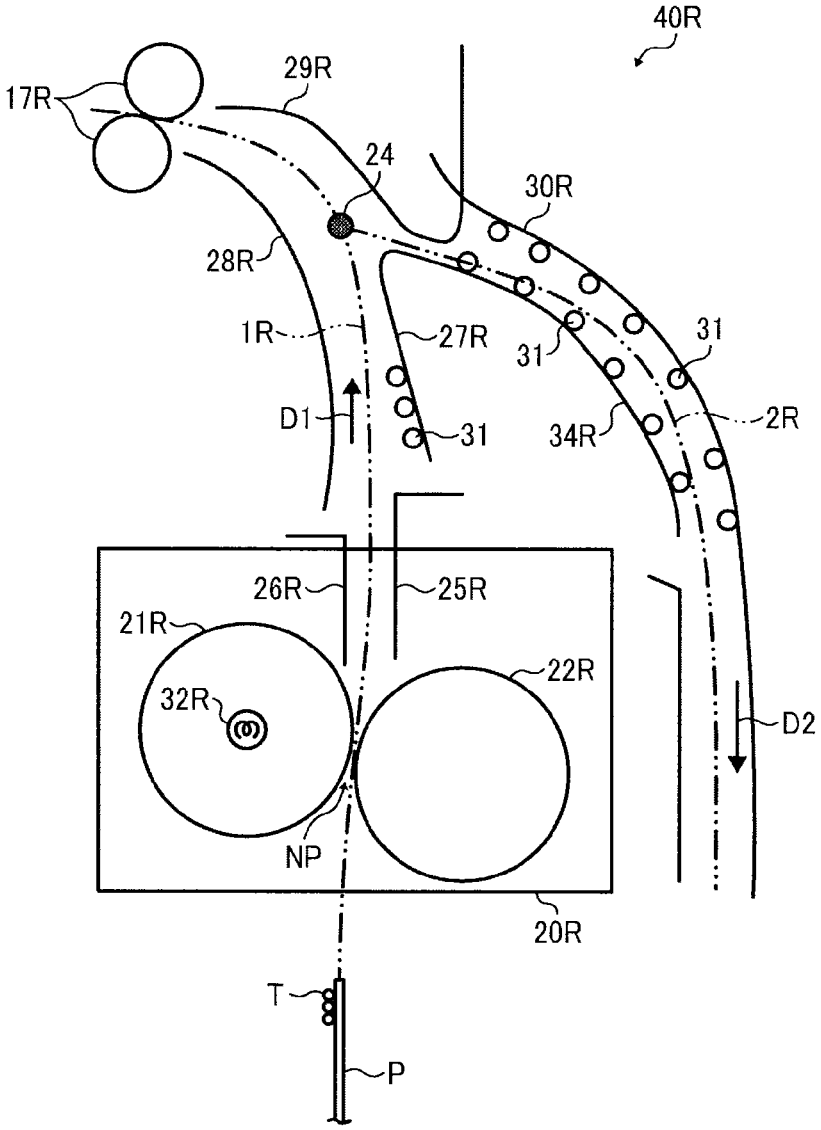
FIG. 1 RELATED ART
FIG. 1 is a schematic vertical sectional view of a related-art guide device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
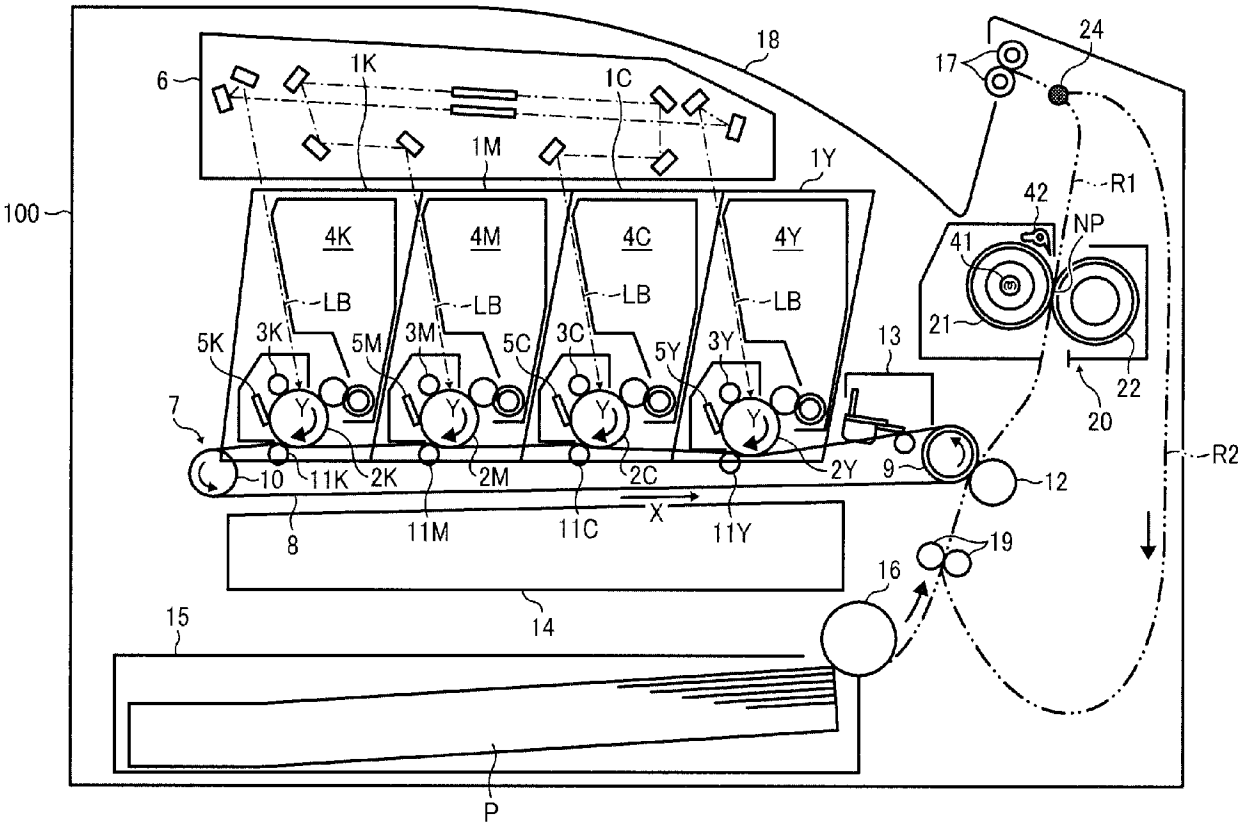
FIG. 2 is a schematic vertical sectional view of an image forming apparatus according to an exemplary embodiment of the present invention.

Referring now to the drawings, wherein like reference numerals designate identical or corresponding parts throughout the several views, in particular to FIG. 2, an image forming apparatus 100 according to an exemplary embodiment of the present invention is explained.

FIG. 2 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a printer for forming color and monochrome toner images on a recording medium by electrophotography.

Referring to FIG. 2, the following describes the structure of the image forming apparatus 100.

The image forming apparatus 100 includes four process units 1Y, 1C, 1M, and 1K detachably attached to the image forming apparatus 100. Although the process units 1Y, 1C, 1M, and 1K contain yellow, cyan, magenta, and black toners that form yellow, cyan, magenta, and black toner images, respectively, resulting in a color toner image, they have an identical structure. Hence, the following describes the structure of one of them, that is, the process unit 1Y that forms a yellow toner image.

For example, the process unit 1Y includes a photoconductive drum 2Y, that is, a photoconductor, serving as an image carrier that carries an electrostatic latent image and a resultant yellow toner image; a charging roller 3Y serving as a charger that charges an outer circumferential surface of the photoconductive drum 2Y; a development device 4Y serving as a development unit that supplies a developer (e.g., yellow toner) to the electrostatic latent image formed on the outer circumferential surface of the photoconductive drum 2Y, thus visualizing the electrostatic latent image into a yellow toner image with the yellow toner; and a cleaning blade 5Y serving as a cleaner that cleans the outer circumferential surface of the photoconductive drum 2Y.

Above the process units 1Y, 1C, 1M, and 1K is an exposure device 6 serving as an exposure unit that emits a laser beam LB onto the outer circumferential surface of the respective photoconductive drums 2Y, 2C, 2M, and 2K to form an electrostatic latent image thereon. Below the process units 1Y, 1C, 1M, and 1K is a transfer unit 7 that accommodates an endless intermediate transfer belt 8 serving as a transferor, a driving roller 9, a driven roller 10, four primary transfer rollers 11Y, 11C, 11M, and 11K, a secondary transfer roller 12, and a belt cleaner 13. Specifically, the endless intermediate transfer belt 8 is stretched over the driving roller 9 and the driven roller 10 and rotatable in a rotation direction X.

Inside a loop formed by the intermediate transfer belt 8 and opposite the four photoconductive drums 2Y, 2C, 2M, and 2K are the four primary transfer rollers 11Y, 11C, 11M, and 11K serving as primary transferors that transfer the yellow, cyan, magenta, and black toner images formed on the photoconductive drums 2Y, 2C, 2M, and 2K, respectively, onto an outer circumferential surface of the intermediate transfer belt 8. The primary transfer rollers 11Y, 11C, 11M, and 11K contact an inner circumferential surface of the intermediate transfer belt 8 and press the intermediate transfer belt 8 against the photoconductive drums 2Y, 2C, 2M, and 2K at opposed positions where the primary transfer rollers 11Y, 11C, 11M, and 11K are disposed opposite the photoconductive drums 2Y, 2C, 2M, and 2K, respectively, via the intermediate transfer belt 8, thus forming primary transfer nips between the photoconductive drums 2Y, 2C, 2M, and 2K and the intermediate transfer belt 8 where the yellow, cyan, magenta, and black toner images formed on the photoconductive drums 2Y, 2C, 2M, and 2K are primarily transferred onto the intermediate transfer belt 8 to form a color toner image thereon. Opposite the driving roller 9 is the secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto the recording medium P.

The belt cleaner 13, disposed opposite the outer circumferential surface of the intermediate transfer belt 8 and in proximity to the secondary transfer nip, cleans the outer circumferential surface of the intermediate transfer belt 8. Below the intermediate transfer unit 7 is a waste toner container 14 that collects waste toner conveyed from the belt cleaner 13 through a waste toner conveyance tube extending from the belt cleaner 13 to an inlet of the waste toner container 14.

In a lower portion of the image forming apparatus 100 are a paper tray 15 that loads a plurality of recording media P (e.g., sheets) and a feed roller 16 that picks up and feeds a recording medium P from the paper tray 15 toward the secondary transfer nip formed between the secondary transfer roller 12 and the intermediate transfer belt 8. In an upper portion of the image forming apparatus 100 are an output roller pair 17 that discharges the recording medium P onto an outside of the image forming apparatus 100 and an output tray 18 that receives and stocks the recording medium P discharged by the output roller pair 17.

The image forming apparatus 100 includes two conveyance paths R1 and R2 through which the recording medium P is conveyed. The first conveyance path R1 extends from the paper tray 15 to the output roller pair 17 to convey the recording medium P from the paper tray 15 located in the lower portion of the image forming apparatus 100 onto the output tray 18 located atop the image forming apparatus 100. The second conveyance path R2 extends from a position upstream from the output roller pair 17 to a position downstream from the feed roller 16 in a recording medium conveyance direction to reverse and convey the recording medium P for duplex printing. The first conveyance path R1 is provided with a registration roller pair 19 interposed between the feed roller 16 and the secondary transfer nip formed between the secondary transfer roller 12 and the intermediate transfer belt 8 in the recording medium conveyance direction. The first conveyance path R1 is further provided with a fixing device 20 disposed downstream from the secondary transfer roller 12 and upstream from the output roller pair 17 in the recording medium conveyance direction. The fixing device 20 fixes the color toner image on the recording medium P. For example, the fixing device 20 (e.g., a fuser unit) includes a fixing roller 21 serving as a fixing rotary body heated by a heater 41; a pressing roller 22 serving as a pressing rotary body or an opposed rotary body that contacts the fixing roller 21 to form a fixing nip NP therebetween; and a separator 42 that separates the recording medium P from the fixing roller 21.

Referring to FIG. 2, the following describes the operation of the image forming apparatus 100 having the structure described above to form a color toner image on a recording medium P.

As a print job starts, a driver drives and rotates the photoconductive drums 2Y, 2C, 2M, and 2K of the process units 1Y, 1C, 1M, and 1K, respectively, clockwise in FIG. 2 in a rotation direction Y. The charging rollers 3Y, 3C, 3M, and 3K uniformly charge the outer circumferential surface of the respective photoconductive drums 2Y, 2C, 2M, and 2K at a predetermined polarity. The exposure device 6 emits laser beams LB onto the charged outer circumferential surface of the respective photoconductive drums 2Y, 2C, 2M, and 2K according to yellow, cyan, magenta, and black image data contained in image data sent from an external device (e.g., a client computer), respectively, thus forming electrostatic latent images thereon. The development devices 4Y, 4C, 4M, and 4K supply yellow, cyan, magenta, and black toners to the electrostatic latent images formed on the photoconductive drums 2Y, 2C, 2M, and 2K, visualizing the electrostatic latent images into yellow, cyan, magenta, and black toner images, respectively.

As the driving roller 9 is driven and rotated counterclockwise in FIG. 2, the driving roller 9 drives and rotates the intermediate transfer belt 8 counterclockwise in FIG. 2 in the rotation direction X. A power supply applies a constant voltage or a constant current control voltage having a polarity opposite a polarity of toner to the primary transfer rollers 11Y, 11C, 11M, and 11K. Thus, a transfer electric field is created at the primary transfer nips formed between the primary transfer rollers 11Y, 11C, 11M, and 11K and the photoconductive drums 2Y, 2C, 2M, and 2K, respectively. Accordingly, the yellow, cyan, magenta, and black toner images formed on the photoconductive drums 2Y, 2C, 2M, and 2K, respectively, are primarily transferred onto the intermediate transfer belt 8 successively by the transfer electric field created at the respective primary transfer nips, in such a manner that the yellow, cyan, magenta, and black toner images are superimposed on a same position on the intermediate transfer belt 8. Consequently, a color toner image is formed on the intermediate transfer belt 8.

After the primary transfer of the yellow, cyan, magenta, and black toner images from the photoconductive drums 2Y, 2C, 2M, and 2K, the cleaning blades 5Y, 5C, 5M, and 5K remove residual toner not transferred and therefore remaining on the photoconductive drums 2Y, 2C, 2M, and 2K therefrom. Then, dischargers discharge the outer circumferential surface of the respective photoconductive drums 2Y, 2C, 2M, and 2K, initializing the potential thereof so that the respective photoconductive drums 2Y, 2C, 2M, and 2K are ready for the next print job.

On the other hand, as the print job starts, the feed roller 16 is driven and rotated to feed a recording medium P from the paper tray 15 toward the registration roller pair 19 through the first conveyance path R1. The registration roller pair 19 feeds the recording medium P to the secondary transfer nip formed between the secondary transfer roller 12 and the driving roller 9 at a time when the color toner image formed on the intermediate transfer belt 8 reaches the secondary transfer nip. The secondary transfer roller 12 is applied with a transfer voltage having a polarity opposite a polarity of the charged yellow, cyan, magenta, and black toners of the yellow, cyan, magenta, and black toner images constituting the color toner image formed on the intermediate transfer belt 8, thus creating a transfer electric field at the secondary transfer nip. Accordingly, the yellow, cyan, magenta, and black toner images constituting the color toner image are secondarily transferred from the intermediate transfer belt 8 collectively onto the recording medium P by the transfer electric field created at the secondary transfer nip.

The recording medium P bearing the color toner image is conveyed to the fixing device 20 where the fixing roller 21 and the pressing roller 22 apply heat and pressure to the recording medium P, fixing the color toner image on the recording medium P. The separator 42 separates the recording medium P bearing the fixed color toner image from the fixing roller 21. Thereafter, the output roller pair 17 discharges the recording medium P onto the output tray 18. After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. The removed toner is conveyed and collected into the waste toner container 14.

The above describes the image forming operation of the image forming apparatus 100 to form the color toner image on the recording medium P. Alternatively, the image forming apparatus 100 may form a monochrome toner image by using any one of the four process units 1Y, 1C, 1M, and 1K or may form a bicolor or tricolor toner image by using two or three of the process units 1Y, 1C, 1M, and 1K.

Referring to FIGS. 3 to 8, the following describes a configuration of a guide device 40 disposed downstream from the fixing device 20 in the recording medium conveyance direction to guide the recording medium P to the output roller pair 17 through the first conveyance path R1 or to the registration roller pair 19 depicted in FIG. 2 through the second conveyance path R2.

Figure 3:
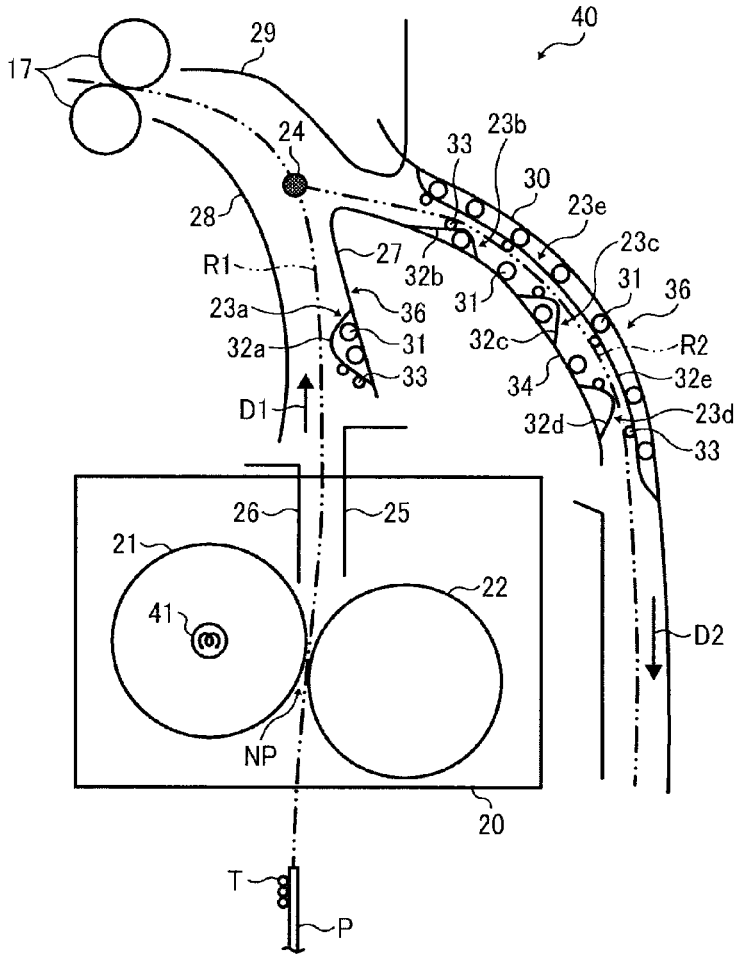
FIG. 3 is a schematic vertical sectional view of a guide device and a fixing device incorporated in the image forming apparatus shown in FIG. 2.
Figure 4:
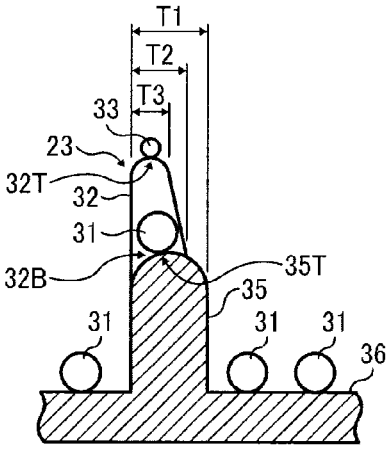
FIG. 4 is a vertical sectional view of a rib combination incorporated in the guide device shown in FIG. 3.
Figure 5:
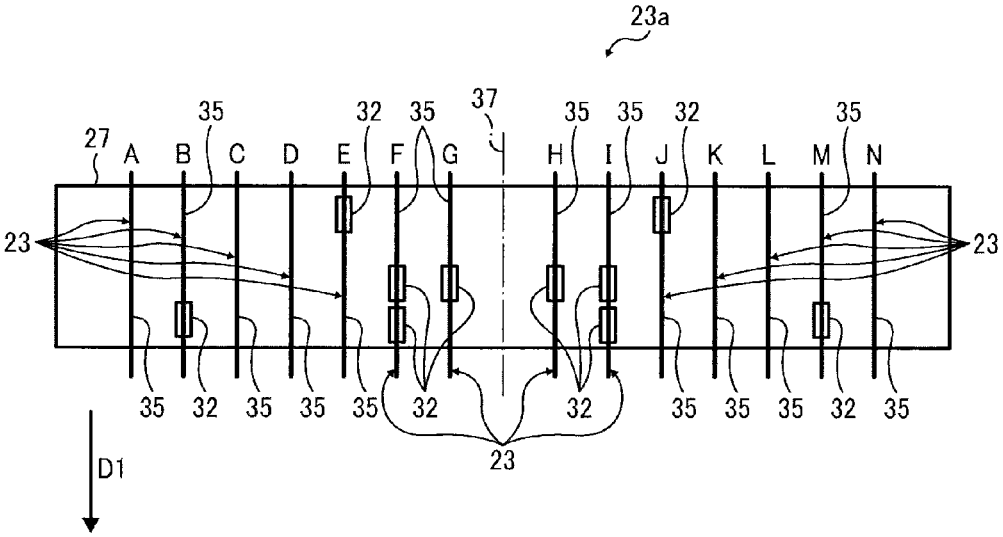
FIG. 5 is a horizontal sectional view of a first rib assembly incorporated in the guide device shown in FIG. 3.
Figure 6:
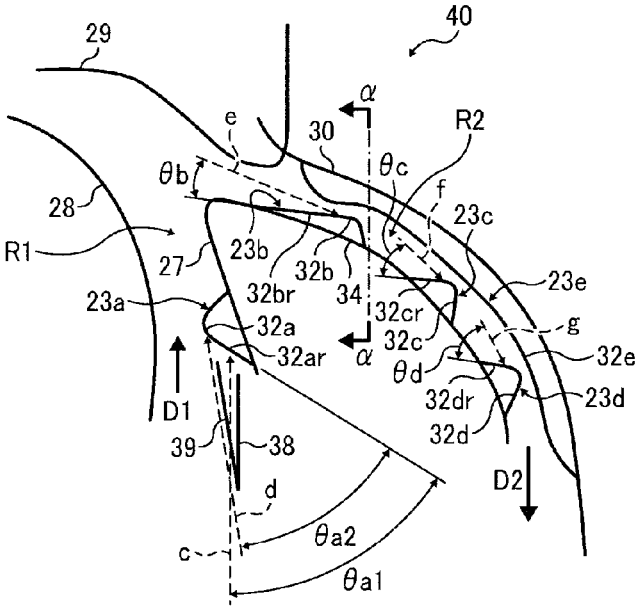
FIG. 6 is a vertical sectional view of the guide device shown in FIG. 3.
Figure 7:
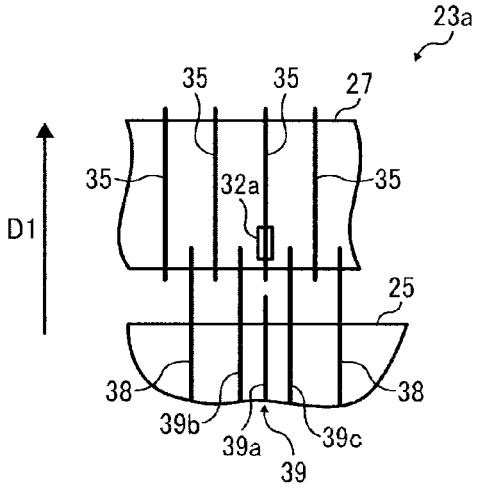
FIG. 7 is a partial horizontal sectional view of a primary guide plate and a secondary guide plate incorporated in the guide device shown in FIG. 6.
Figure 8:
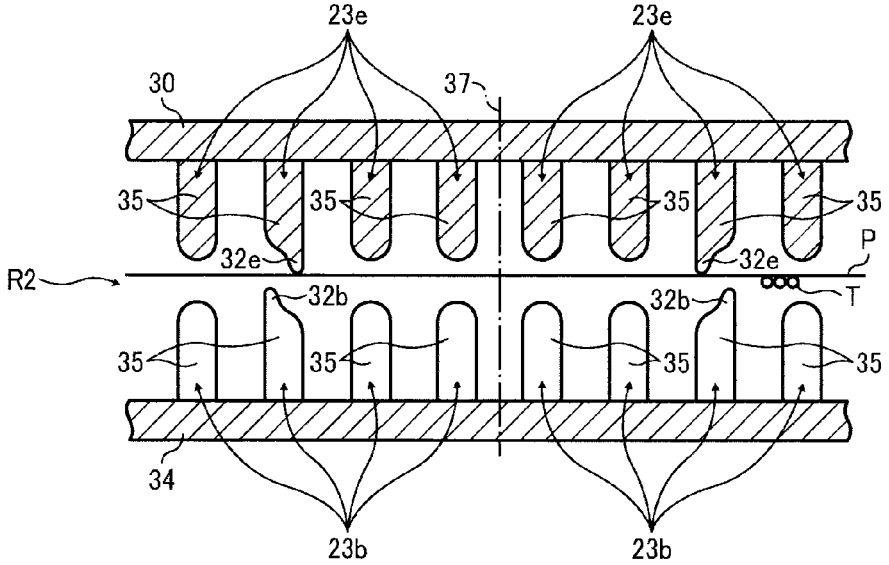
FIG. 8 is a sectional view of a second conveyance path incorporated in the guide device shown in FIG. 6 taken along a line a-a in FIG. 6.

FIG. 3 is a schematic vertical sectional view of the guide device 40 and the fixing device 20. FIG. 4 is a vertical sectional view of a rib combination 23 incorporated in the guide device 40. FIG. 5 is a horizontal sectional view of a first rib assembly 23*a* incorporated in the guide device 40. FIG. 6 is a vertical sectional view of the guide device 40. FIG. 7 is a partial horizontal sectional view of primary guide plates 38 and a secondary guide plate 39 incorporated in the guide device 40. FIG. 8 is a sectional view of the second conveyance path R2 taken along a line a-a in FIG. 6.

As shown in FIG. 3, the first conveyance path R1 extends through the fixing device 20 to the output roller pair 17 to convey a recording medium P bearing a toner image T. A pressing exit guide 25 disposed downstream from the pressing roller 22 in a recording medium conveyance direction D1 is disposed opposite a fixing exit guide 26 disposed downstream from the fixing roller 21 in the recording medium conveyance direction D1. The pressing exit guide 25 and the fixing exit guide 26 contact the recording medium P discharged from the fixing nip NP as needed to guide the recording medium P toward the output roller pair 17. Conveyance walls 36 constituting the first conveyance path R1 are disposed downstream from the pressing exit guide 25 and the fixing exit guide 26 and upstream from the output roller pair 17 in the recording medium conveyance direction D1. The conveyance walls 36 constituting the first conveyance path R1 are a first output guide 28 extending from the fixing exit guide 26 to the output roller pair 17, a second output guide 27, that is, a first conveyance wall plate, extending from the pressing exit guide 25 to a bifurcation 24, and a third output guide 29 extending from the bifurcation 24 to the output roller pair 17.

The second conveyance path R2 extends from the bifurcation 24 to the registration roller pair 19 depicted in FIG. 2 to reverse and convey the recording medium P discharged from the fixing device 20 to the registration roller pair 19 for duplex printing. The conveyance walls 36 constituting the second conveyance path R2 are disposed downstream from the bifurcation 24 and upstream from the registration roller pair 19 in a recording medium conveyance direction D2. The conveyance walls 36 constituting the second conveyance path R2 are a first duplex guide 34, that is, a first conveyance wall plate, contiguous to the second output guide 27 and extending to the registration roller pair 19 and a second duplex guide 30, that is, a second conveyance wall plate, contiguous to the third output guide 29 and extending to the registration roller pair 19.

If a user selects a duplex printing mode for forming a toner image T on both sides of a recording medium P, the recording medium P is conveyed through the first conveyance path R1 and immediately after a trailing edge of the recording medium P passes through the bifurcation 24, the trailing edge of the recording medium P springs toward the second conveyance path R2 by its rigidity. Before the trailing edge of the recording medium P reaches the output roller pair 17, the output roller pair 17 reverses its direction of rotation, feeding the recording medium P toward the second conveyance path R2. Then, the recording medium P is conveyed through the second conveyance path R2 and enters the first conveyance path R1 at the position upstream from the registration roller pair 19 depicted in FIG. 2 in the recording medium conveyance direction. The recording medium P is conveyed through the first conveyance path R1 to the secondary transfer nip in a state in which a back side of the recording medium P bearing no toner image T faces the intermediate transfer belt 8. Thus, as the recording medium P is conveyed through the secondary transfer nip, a color toner image is transferred from the intermediate transfer belt 8 onto the back side of the recording medium P.

The first conveyance path R1 is provided with the first rib assembly 23*a*. The second conveyance path R2 is provided with a second rib assembly 23*b*, a third rib assembly 23*c*, a fourth rib assembly 23*d*, and a fifth rib assembly 23*e*. As shown in FIG. 5, the first rib assembly 23*a* includes a plurality of primary ribs 35 aligned in a direction orthogonal to the recording medium conveyance direction D1. Similarly, each of the second to fifth rib assemblies 23*b* to 23*e* includes a plurality of primary ribs 35 aligned in a direction orthogonal to the recording medium conveyance direction D2. Each primary rib 35 extends in the recording medium conveyance direction D1 or D2. For example, as shown in FIG. 3, the first rib assembly 23*a* is mounted on the second output guide 27; the second rib assembly 23*b*, the third rib assembly 23*c*, and the fourth rib assembly 23*d* are mounted on the first duplex guide 34; the fifth rib assembly 23*e* is mounted on the second duplex guide 30. The first to fifth rib assemblies 23*a* to 23*e* are mounted on the conveyance walls 36, that is, an interior wall of the second output guide 27, the first duplex guide 34, and the second duplex guide 30 adhered with water droplets 31 noticeably when the image forming apparatus 100 depicted in FIG. 2 is powered on or switched from a sleep mode to a print mode. As shown in FIGS. 3 and 5, the first rib assembly 23*a* includes a plurality of plate-shaped rib combinations 23 that protrudes from the second output guide 27 with a mountain shape in cross-section; each of the second to fourth rib assemblies 23*b* to 23*d* includes a plurality of plate-shaped rib combinations 23 that protrudes from the first duplex guide 34 with a mountain shape in cross-section; the fifth rib assembly 23*e* includes a plurality of plate-shaped rib combinations 23 that protrudes from the second duplex guide 30.

As shown in FIG. 5, the first to fifth rib assemblies 23*a* to 23*e* have some rib combinations 23 provided with a secondary rib 32 and the other rib combinations 23 not provided with the secondary rib 32.

FIG. 4 illustrates a configuration of one of the rib combinations 23. The rib combination 23 is constructed of a primary rib 35 protruding from the interior wall of the conveyance wall 36 constituting the first conveyance path R1 or the second conveyance path R2; and the secondary rib 32 mounted on the primary rib 35. The secondary rib 32 has a thickness in the direction orthogonal to the recording medium conveyance direction D1 smaller than that of the primary rib 35. For example, the thickness of the secondary rib 32 decreases from a top 32T thereof that contacts the recording medium P to a bottom 32B thereof that contacts the primary rib 35. Specifically, a thickness T3 in the direction orthogonal to the recording medium conveyance direction D1 of the top 32T of the secondary rib 32 is smaller than a thickness T2 in the direction orthogonal to the recording medium conveyance direction D1 of the bottom 32B of the secondary rib 32 that is smaller than a thickness T1 in the direction orthogonal to the recording medium conveyance direction D1 of the primary rib 35. The rib combination 23 without the secondary rib 32 is constructed of the primary rib 35 only.

When the image forming apparatus 100 depicted in FIG. 2 is powered on or switched from the sleep mode to the print mode, water droplets 31 may adhere to the interior wall of the conveyance wall 36 and the primary rib 35 as shown in FIG. 4. Since a surface area of the top 32T of the secondary rib 32 is smaller than that of the interior wall of the conveyance wall 36 and a top 35T of the primary rib 35, a water droplet 33 smaller than the water droplet 31 may adhere to the top 32T of the secondary rib 32. However, even if the smaller water droplet 33 adheres to the top 32T of the secondary rib 32, since the secondary rib 32 has a volume and a heat capacity smaller than those of the primary rib 35 and the conveyance wall 36, the secondary rib 32 is warmed quickly and dried before the recording medium P discharged from the fixing nip NP depicted in FIG. 3 reaches the rib combination 23. Alternatively, even if the smaller water droplet 33 is transferred to the recording medium P, the recording medium P is dried while it is conveyed through the first conveyance path R1 or the second conveyance path R2, preventing failures such as damage to the recording medium P and the toner image T formed on the recording medium P.

The primary rib 35, the secondary rib 32, and the conveyance wall 36 are made of an identical material (e.g., molded plastic), reducing manufacturing costs. The thickness of the secondary rib 32 decreases from the top 32T thereof that contacts the recording medium P to the bottom 32B thereof that is isolated from the recording medium P, preventing failure of parts due to degraded fluidity of the material of the secondary rib 32. Further, the thickness T2 of the bottom 32B of the secondary rib 32 is greater than the thickness T3 of the top 32T of the secondary rib 32, preventing the secondary rib 32 from being broken due to insufficient mechanical strength.

As shown in FIG. 5, a plurality of primary ribs 35 is aligned in the direction orthogonal to the recording medium conveyance direction D1 or D2 in which the recording medium P is conveyed through the first conveyance path R1 or the second conveyance path R2. The number of the secondary ribs 32 is in a range of from about 30 percent to about 70 percent of the total number of the primary ribs 35. If the number of the secondary ribs 32 is smaller than about 30 percent of the total number of the primary ribs 35, the number of the secondary ribs 32 disposed in the first conveyance path R1 and the second conveyance path R2 is too small for the secondary ribs 32 to prevent the water droplets 31 from adhering to the recording medium P. Conversely, if the number of the secondary ribs 32 is greater than about 70 percent of the total number of the primary ribs 35, the number of the secondary ribs 32 disposed in the first conveyance path R1 and the second conveyance path R2 is too much to prevent the recording medium P from being jammed. It is because a contact angle θ formed between the recording medium P and a downstream slope of the secondary rib 32 as a leading edge of the recording medium P passes over the top 32T of the secondary rib 32 is greater than a contact angle formed between the recording medium P and the primary rib 35.

As shown in FIG. 5, according to this exemplary embodiment, fourteen primary ribs 35 indicated by A to N are mounted on the second output guide 27 in the direction orthogonal to the recording medium conveyance direction D1 of the recording medium P conveyed through the first conveyance path R1; ten secondary ribs 32 are mounted on eight of the fourteen primary ribs 35. That is, the secondary ribs 32 are mounted on about 57 percent of the total number of the primary ribs 35 of the first rib assembly 23*a*.

As shown in FIG. 5, the extension of the length of one or more secondary ribs 32 in the recording medium conveyance direction D1 is not greater than about 50 percent of the extension of the length of the single primary rib 35. That is, the combined length of the top 32T of one or more secondary ribs 32 mounted on the single primary rib 35 is not greater than about 50 percent of the length of the single primary rib 35. If the extension of the length of one or more secondary ribs 32 is greater than about 50 percent of the extension of the length of the single primary rib 35 in the recording medium conveyance direction D1, the recording medium P may be jammed. To address this problem, according to this exemplary embodiment, the extension of the length of the two secondary ribs 32 mounted on each of the primary ribs 35 indicated by F and I is greater than the extension of the single secondary rib 32 mounted on each of the primary ribs 35 indicated by B, E, G, H, J, and M. For example, the extension of the length of the two secondary ribs 32 occupies about 30 percent of the extension of the length of each of the primary ribs 35 indicated by F and I in the recording medium conveyance direction D1.

As shown in FIG. 5, the secondary ribs 32 are symmetric with respect to a center line 37 extending in the recording medium conveyance direction D1. According to this exemplary embodiment, the center line 37 corresponds to a center line of the recording medium P in the direction orthogonal to the recording medium conveyance direction D1. Similarly, the configuration shown in FIG. 5 is applicable to the second to fifth rib assemblies 23*b*, 23*c*, 23*d*, and 23*e* provided in the second conveyance path R2 shown in FIG. 3. Further, as shown in FIG. 8, the secondary ribs 32 illustrated as secondary ribs 32*b* and 32*e* have a round shape symmetric with respect to the center line 37.

FIG. 8 illustrates the second rib assembly 23*b* and the fifth rib assembly 23*e* disposed opposite the second rib assembly 23*b* as shown in FIG. 3. For example, as shown in FIG. 8, the round shape of the secondary ribs 32*e* of the fifth rib assembly 23*e* is symmetric with respect to the center line 37; the round shape of the secondary ribs 32*b* of the second rib assembly 23*b* is symmetric with respect to the center line 37. Accordingly, the symmetric secondary ribs 32*e* and 32*b* impose load to the recording medium P conveyed through the second conveyance path R2 evenly throughout the entire width of the recording medium P in the direction orthogonal to the recording medium conveyance direction D2, preventing skew or serpentine movement of the recording medium P.

Referring to FIGS. 6 and 7, a detailed description is now given of the primary guide plate 38 and the secondary guide plate 39.

FIG. 6 is an enlarged vertical sectional view of the first conveyance path R1 and the second conveyance path R2. FIG. 7 is a partial horizontal sectional view of the primary guide plate 38 and the secondary guide plate 39. The primary guide plate 38 (e.g., a guide rib) and the secondary guide plate 39 (e.g., a guide rib) are attached to the pressing exit guide 25 depicted in FIG. 3 and disposed upstream from the first rib assembly 23*a* in the recording medium conveyance direction D1. As shown in FIG. 7, the primary guide plate 38 guides the recording medium P to the primary rib 35 not mounting a secondary rib 32*a*; the secondary guide plate 39 guides the recording medium P to the secondary rib 32*a*. The primary guide plate 38 is constructed of a single rib. Conversely, the secondary guide plate 39 is constructed of three ribs: a center rib 39*a* disposed on an extension of the secondary rib 32*a* and side ribs 39*b* and 39*c* sandwiching the center rib 39*a*. According to this exemplary embodiment, since the first rib assembly 23*a* includes at least four secondary ribs 32*a* mounted on the four primary ribs 35, four secondary guide plates 39 are disposed upstream from the first rib assembly 23*a* in the recording medium conveyance direction D1. That is, twelve ribs constituting the four secondary guide plates 39 are attached to the pressing exit guide 25.

As shown in FIG. 6, the secondary guide plate 39 projects inward inside the first conveyance path R1 in such a manner that the secondary guide plate 39 narrows the first conveyance path R1 more than the primary guide plate 38. For example, when the leading edge of the recording medium P guided by the secondary guide plate 39 disposed in proximity to the secondary rib 32*a* contacts the secondary rib 32*a*, the recording medium P indicated by a dotted line d and a ridge line 32*ar* of the secondary rib 32*a* form a contact angle θa2.

If the primary guide plate 38 is disposed in proximity to the secondary rib 32*a*, when the leading edge of the recording medium P guided by the primary guide plate 38 contacts the secondary rib 32*a*, the recording medium P indicated by a dotted line c and the ridge line 32*ar* of the secondary rib 32*a* form a contact angle θa1 that is greater than the contact angle θa2. The smaller contact angle θa2 reduces load imposed from the secondary rib 32*a* to the recording medium P, thus preventing the recording medium P from being jammed and decelerating wear of the secondary rib 32*a*.

Referring to FIG. 6, a detailed description is now given of a configuration of the second to fourth rib assemblies 23*b* to 23*d*. As shown in FIG. 6, the second conveyance path R2 is provided with the second to fourth rib assemblies 23*b* to 23*d* aligned in this order in the recording medium conveyance direction D2. That is, a plurality of secondary ribs 32*b*, 32*c*, and 32*d* mounted on the first duplex guide 34 is aligned in this order in the recording medium conveyance direction D2 on the first duplex guide 34 inside the second conveyance path R2. When the leading edge of the recording medium P contacts the secondary rib 32*b*, the recording medium P indicated by a dotted line e and a ridge line 32*br* of the secondary rib 32*b* form a contact angle θb. When the leading edge of the recording medium P contacts the secondary rib 32*c*, the recording medium P indicated by a dotted line f and a ridge line 32*cr* of the secondary rib 32*c* form a contact angle θc. When the leading edge of the recording medium P contacts the secondary rib 32*d*, the recording medium P indicated by a dotted line g and a ridge line 32*dr* of the secondary rib 32*d* form a contact angle θd. According to this exemplary embodiment, the contact angle θc provided downstream from the contact angle θb in the recording medium conveyance direction D2 is greater than the contact angle θb. The contact angle θd provided downstream from the contact angle θc in the recording medium conveyance direction D2 is greater than the contact angle θc.

The second conveyance path R2 receives the recording medium P switched back and reversed by the output roller pair 17 depicted in FIG. 3. At a position in proximity to an entry to the second conveyance path R2, that is, at a position in proximity to the second rib assembly 23*b*, movement of the reversed recording medium P is unstable. As the recording medium P passes over the third rib assembly 23*c* and the fourth rib assembly 23*d*, movement of the recording medium P is stabilized. To address this circumstance, the smaller contact angle θb formed between the recording medium P indicated by the dotted line e and the ridge line 32*br* of the secondary rib 32*b* increases the area where the recording medium P contacts the secondary rib 32*b*, stabilizing movement of the recording medium P at the position in proximity to the entry to the second conveyance path R2. Although the contact angle θb is small, the contact angles θc and θd are relatively great. Accordingly, the area where the recording medium P contacts the secondary ribs 32*c* and 32*d* is minimized, thus decreasing failures that may arise due to transfer of water droplets 33 from the secondary ribs 32*c* and 32*d* to the recording medium P.

Referring to FIGS. 6 and 8, a detailed description is now given of a configuration of the fifth rib assembly 23*e*.

As shown in FIG. 6, the second to fourth rib assemblies 23*b* to 23*d* are mounted on the first duplex guide 34. Conversely, the fifth rib assembly 23*e* is mounted on the second duplex guide 30. Accordingly, as shown in FIG. 8, the primary ribs 35 mounting the secondary ribs 32*b* face the front side of the recording medium P that bears the fixed toner image T. Conversely, the primary ribs 35 mounting the secondary ribs 32*e* face the back side of the recording medium P that bears no toner image T. The primary ribs 35 mounted on the second duplex guide 30 are disposed opposite the primary ribs 35 mounted on the first duplex guide 34. However, the secondary ribs 32*e* mounted on the primary ribs 35 of the fifth rib assembly 23*e* are shifted from the secondary ribs 32*b* mounted on the primary ribs 35 of the second rib assembly 23*b* in the direction orthogonal to the recording medium conveyance direction D2. Accordingly, although the secondary ribs 32*e* and 32*b* protrude from the primary ribs 35, they do not narrow the second conveyance path R2, minimizing load imposed from the secondary ribs 32*e* and 32*b* to the recording medium P conveyed through the second conveyance path R2 and thereby preventing the recording medium P from being jammed.

The present invention is not limited to the details of the exemplary embodiments described above, and various modifications and improvements are possible. For example, a recording medium P may be plain paper generally used for copying, special sheets having a relatively great heat capacity such as OHP (overhead projector) transparencies, thick paper having weight of 90K or more (e.g., cards and postcards), thick paper having paper weight of about 100 g/m$^2$ or greater, envelopes, or the like.

Referring to FIGS. 2 to 5, the following describes advantages of the guide device 40 disposed downstream from the fixing device 20 in the recording medium conveyance direction D1. As shown in FIG. 3, the guide device 40 includes the first conveyance path R1 and the second conveyance path R2 through which a recording medium P passes, that bears a toner image T fixed thereon as the recording medium P is conveyed through the fixing nip NP formed between the fixing roller 21 and the pressing roller 22. The first conveyance path R1 is constructed of the second output guide 27 serving as a first conveyance wall plate mounting the first rib assembly 23*a*; the second conveyance path R2 is constructed of the first duplex guide 34 serving as a first conveyance wall plate mounting the second to fourth rib assemblies 23*b* to 23*d* and the second duplex guide 30 serving as a second conveyance wall plate mounting the fifth rib assembly 23*e*. As shown in FIG. 5, each of the first to fifth rib assemblies 23*a* to 23*e* is constructed of the plurality of primary ribs 35 and the plurality of secondary ribs 32 mounted on selected ones of the plurality of primary ribs 35. As shown in FIG. 4, the secondary rib 32 has the thickness smaller than that of the primary rib 35 and increasing from the top 32T to the bottom 32B thereof contacting the primary rib 35.

When the image forming apparatus 100 is powered on or switched from the sleep mode to the print mode, water droplets 31 or 33 may adhere to the conveyance wall 36 constructed of the second output guide 27, the first duplex guide 34, or the second duplex guide 30 mounting the primary rib 35 and the secondary rib 32 as shown in FIG. 4. Since the top 32T of the secondary rib 32 is smaller than the top 35T of the primary rib 35 as shown in FIG. 4, the water droplet 33 smaller than the water droplet 31 adhering to the conveyance wall 36 and the primary rib 35 may adhere to the secondary rib 32. The volume of the secondary rib 32 is smaller than that of the primary rib 35 and the conveyance wall 36, providing a smaller heat capacity and thereby facilitating heating of the secondary rib 32. Accordingly, even if the smaller water droplet 33 adheres to the top 32T of the secondary rib 32, the smaller water droplet 33 is dried before the recording medium P conveyed from the fixing device 20 reaches the secondary rib 32. Even if the smaller water droplet 33 is transferred from the secondary rib 32 to the recording medium P, the smaller water droplet 33 is dried while the recording medium P is conveyed through the first conveyance path R1 or the second conveyance path R2. Accordingly, the secondary rib 32 mounted on the primary rib 35 minimizes the water droplets 33 and 31 adhering to the recording medium P, thus preventing or minimizing failures such as damage to the recording medium P and the toner image T formed on the recording medium P.

The guide device 40 and the image forming apparatus 100 incorporating the guide device 40 prevent the water droplet 31 adhered to the primary rib 35 and the conveyance wall 36 and the water droplet 33 adhered to the secondary rib 32 from being transferred to the recording medium P as the recording medium P is conveyed over the secondary rib 32. Accordingly, even if the image forming apparatus 100 shortens a first print time that starts a fixing operation in a state in which the fixing roller 21 is heated to a predetermined fixing temperature but other components such as the fixing exit guide 26, the pressing exit guide 25, the conveyance wall 36, the primary rib 35, and the secondary rib 32 are not yet heated, and therefore the water droplets 31 and 33 adhere to these components, the secondary rib 32 mounted on the primary rib 35 prevents the water droplets 33 and 31 from being transferred onto the recording medium P, thereby preventing damage to the toner image T on the recording medium P without extra component or special material at reduced manufacturing costs.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A guide device that is disposed downstream from a fixing device, which fixes a toner image on a recording medium in a recording medium conveyance direction, and that guides the recording medium discharged from the fixing device, the guide device comprising:

a first conveyance wall plate; and at least one rib assembly mounted on the first conveyance wall plate, including:

a plurality of primary ribs contacting the first conveyance wall plate, each having a first thickness in a direction orthogonal to the recording medium conveyance direction, and a plurality of secondary ribs mounted on selected ones of the plurality of primary ribs, wherein the selected ones of the plurality of primary ribs comprises fewer than all of the primary ribs, each secondary rib including:

a bottom contacting the primary rib and having a second thickness in the direction orthogonal to the recording medium conveyance direction that is smaller than the first thickness of the primary rib, and a top contacting the recording medium and having a third thickness in the direction orthogonal to the recording medium conveyance direction that is smaller than the second thickness of the bottom of the secondary rib.

2. The guide device according to claim 1, wherein the plurality of primary ribs is aligned in a direction orthogonal to the recording medium conveyance direction.

3. The guide device according to claim 2, wherein a number of the plurality secondary ribs is in a range of from about 30 percent to about 70 percent of a number of the plurality of primary ribs.

4. The guide device according to claim 2, wherein each of the selected ones of the plurality of primary ribs have mounted thereon one or more of the plurality of secondary ribs aligned straight in the recording medium conveyance direction.

5. The guide device according to claim 4, wherein a total length of extension in the recording medium conveyance direction of the top of the one or more secondary ribs mounted on a single one of the selected ones of the plurality of primary ribs is not greater than about 50 percent of a length of extension in the recording medium conveyance direction of the single one of the selected ones of the plurality of primary ribs.

6. The guide device according to claim 2, wherein the at least one rib assembly includes:

an upstream rib assembly; and a downstream rib assembly disposed downstream from the upstream rib assembly in the recording medium conveyance direction, and wherein a contact angle formed between a leading edge of the recording medium and the top of the secondary rib of the downstream rib assembly is greater than a contact angle formed between the leading edge of the recording medium and the top of the secondary rib of the upstream rib assembly.

7. The guide device according to claim 2, wherein the plurality of secondary ribs is symmetric with respect to a center line of the first conveyance wall plate that extends in the recording medium conveyance direction.

8. The guide device according to claim 7, wherein the plurality of secondary ribs has a round shape that is symmetric with respect to the center line.

9. The guide device according to claim 2, further comprising a second conveyance wall plate having mounted thereon a plurality of primary ribs and a plurality of secondary ribs, the second conveyance wall plate being disposed opposite the first conveyance wall plate via the recording medium, wherein the plurality of secondary ribs protruding from the plurality of primary ribs mounted on the first conveyance wall plate is shifted from the plurality of secondary ribs protruding from the plurality of primary ribs mounted on the second conveyance wall plate in the direction orthogonal to the recording medium conveyance direction.

10. The guide device according to claim 2, further comprising:

a plurality of primary guide plates disposed upstream from the plurality of primary ribs in the recording medium conveyance direction, the plurality of primary guide plates not having secondary ribs mounted thereon, and the plurality of primary guide plates guiding the recording medium to the plurality of primary ribs of the at least one rib assembly; and a plurality of secondary guide plates disposed upstream from the plurality of primary ribs in the recording medium conveyance direction, the plurality of secondary guide plates having mounted thereon secondary ribs, and the plurality of secondary guide plates guiding the recording medium to the plurality of secondary ribs of the at least one rib assembly.

11. The guide device according to claim 10, wherein each secondary guide plate includes:

a center rib disposed on an extension of one of the plurality of the secondary ribs of the at least one rib assembly; and two side ribs sandwiching the center rib.

12. The guide device according to claim 11, wherein a contact angle formed between a leading edge of the recording medium guided by the secondary guide plate and contacting the one of the plurality of the secondary ribs of the at least one rib assembly and a ridge line of the one of the plurality of the secondary ribs of the at least one rib assembly is smaller than a contact angle formed between the leading edge of the recording medium guided by the primary guide plate and the ridge line of the one of the plurality of the secondary ribs of the at least one rib assembly.

13. The guide device according to claim 1, wherein the first conveyance wall plate, the plurality of primary ribs, and the plurality of secondary ribs are made of an identical material.

14. The guide device according to claim 13, wherein the first conveyance wall plate, the plurality of primary ribs, and the plurality of secondary ribs are molded plastic.

15. An image forming apparatus comprising the guide device according to claim 1.

* * * * *